US006528036B2

(12) United States Patent
Nishimura et al.

(10) Patent No.: US 6,528,036 B2
(45) **Date of Patent: *Mar. 4, 2003**

(54) MILLED CARBON FIBER AND PROCESS FOR PRODUCING THE SAME

(75) Inventors: Yoshiyuki Nishimura, Kashima-gun (JP); Hiroshi Ejiri, Kashima-gun (JP)

(73) Assignee: Kashima Oil Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/929,017

(22) Filed: Aug. 15, 2001

(65) Prior Publication Data

US 2001/0051126 A1 Dec. 13, 2001

Related U.S. Application Data

(62) Division of application No. 08/306,610, filed on Sep. 15, 1994.

(30) Foreign Application Priority Data

Sep. 17, 1993 (JP) ..... 5-253595

(51) Int. Cl.[7] ..... D01F 9/12
(52) U.S. Cl. ..... 423/447.4; 423/447.6
(58) Field of Search ..... 423/447.4, 447.6; 264/29.7

(56) References Cited

U.S. PATENT DOCUMENTS

| | | | | | |
|---|---|---|---|---|---|
| 4,686,096 | A | * | 8/1987 | Schulz et al. | 423/447.1 |
| 4,822,587 | A | | 4/1989 | Hino et al. | 423/449.2 |
| 5,169,616 | A | | 12/1992 | Ross | 423/449.2 |
| 5,227,238 | A | | 7/1993 | Hirai et al. | 423/449.2 |
| 5,254,396 | A | | 10/1993 | Takemura et al. | 423/447.4 |
| 5,283,113 | A | | 2/1994 | Nishimura et al. | 423/447.4 |
| 5,292,473 | A | | 3/1994 | Maeda et al. | 264/183 |
| 5,336,557 | A | | 8/1994 | Takamatsu et al. | 428/367 |
| 5,356,574 | A | | 10/1994 | Tamaki et al. | 423/448 |
| 5,370,856 | A | | 12/1994 | Arai et al. | 423/449.2 |
| 5,698,341 | A | * | 12/1997 | Tamaki et al. | 429/218 |
| 6,303,095 | B1 | * | 10/2001 | Nishimura et al. | 423/447.2 |

FOREIGN PATENT DOCUMENTS

DE 37 34 226 4/1989

OTHER PUBLICATIONS

Carbon, vol. 26, No. 4, pp. 565–571, 1988, Gen Katagiri, et al., "Raman Spectra of Graphite Edge Planes".

Database Inspec Accession, 3780805, vol. 51, No. 1, Jun. 1990.

* cited by examiner

*Primary Examiner*—Stuart L. Hendrickson
(74) *Attorney, Agent, or Firm*—Oblon, Spivak, McClelland, Maier & Neustadt, P.C.

(57) ABSTRACT

Milled carbon fibers are provided which have a fiber cut surface and a fiber axis intersecting with each other at cross angles, the smaller one thereof being at least 65° on the average. The milled carbon fibers may have a specific surface area as measured by the BET method of 0.2 to 10 $m^2/g$. The milled carbon fibers may be obtained by a process comprising melt spinning of mesophase pitch, infusibilization, milling of the infusibilized pitch fibers as obtained or after a primary heat treatment at low temperatures in an inert gas and a high-temperature heat treatment in an inert gas. Even when the graphite layer plane has achieved high-level growth, the above milled carbon fibers have low reactivity with a metal of high temperature or the like during the molding or use thereof because the proportion of reactive exposed surface of the inner portion of the fiber is small, so that the use of the milled carbon fibers can improve the mechanical strength and high-temperature heat resistance of the composite material.

9 Claims, 1 Drawing Sheet

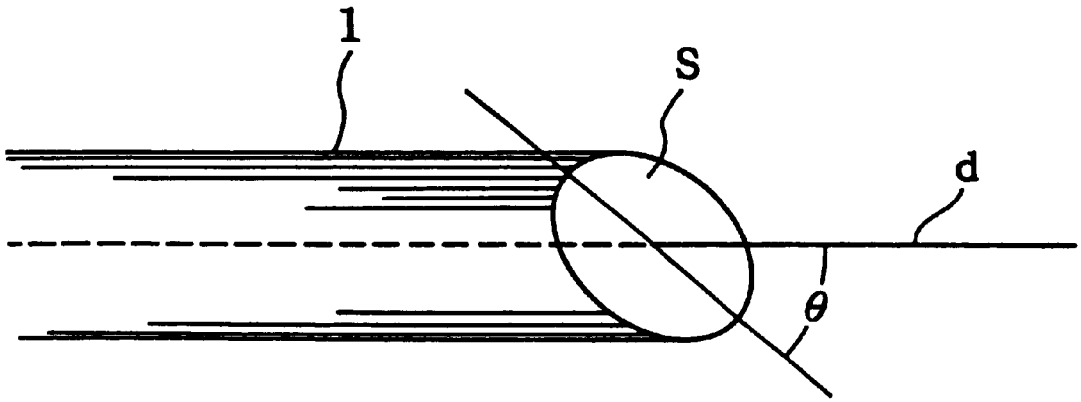
1
S
d
θ

MILLED CARBON FIBER AND PROCESS FOR PRODUCING THE SAME

FIELD OF THE INVENTION

The present invention relates to milled carbon fibers. More particularly, the present invention is concerned with milled carbon fibers which have a large surface area available for contact with metals, etc., so that it is suitable for improving the rigidity and high-temperature heat resistance of metals, alloys and the like, thereby ensuring advantageous utilization thereof in, for example, carbon-fiber-reinforced composite materials. Also, the present invention is concerned with a process for producing the milled carbon fiber.

BACKGROUND OF THE INVENTION

The carbon fiber is lightweight and has high strength and rigidity, so that in recent years it is utilized in a wide spectrum of fields from the aerospace and aircraft industry to the general industries.

For example, carbon-fiber-reinforced plastics are actually widely utilized as structural materials having high specific strength and specific modulus of elasticity. Further, carbon-fiber-reinforced metals (CFRM), such as carbon-fiber-reinforced aluminum alloys and carbon-fiber-reinforced magnesium alloys (hereinafter referred to as "CFRAl(Mg)"), have been developed as materials having excellent high-temperature dimensional stability and thermal deformation resistance, and their use is anticipated as a material for use in structural members for aerospace and aircraft and engine members for vehicles.

However, the production of CFRAl(Mg) has encountered, for example, a problem such that not only is the wettability of the carbon fiber with molten Al (or Mg) poor but also, once the wetting is effected, the carbon fiber reacts with Al to thereby form $Al_4C_3$ with the result that the strength of the material is lowered.

The amount of formed $Al_4C_3$ is connected with the type of the carbon fiber. That is, the carbon fiber produced by heat treating at a temperature of about 2000° C., known as "graphitized carbon fiber", has a high carbon crystallization degree and a strong carbon-to-carbon bond to render itself stable, as compared with the carbon fiber produced by heat treating at a temperature of about 1500° C., known as "carbonized carbon fiber", so that the reactivity with molten Al alloy or the like is poor, thereby minimizing the formation of carbides, such as aluminum carbide.

Therefore, the mechanical properties of the CFRAl(Mg) are superior when the graphitized carbon fiber is used as reinforcement.

The graphite crystals of the graphitized carbon fiber are generally highly anisotropic from the dynamical, electrical and scientific viewpoints, because the carbons interact each other between the graphite layer planes with only weak intermolecular force while the $sp^2$ carbons are strongly bonded within each of the graphite layer planes (c-planes).

In the so-called monoaxially oriented structure in which the c-planes are arranged parallel to the fiber axis, there may be some mutually different microstructures or high-order structures, depending on the type of the carbon fiber precursor (polyacrylonitrile (PAn), rayon, pitch, etc.).

Of the above precursors, when mesophase pitch with greater graphitizability is used as a starting material, the graphitization is more readily promoted even at the same heat treating temperature to thereby produce carbon fibers having higher modulus of elasticity. Therefore, the use of carbon fibers of high elastic modulus derived from mesophase pitch is especially promising in the formation of a composite with an aluminum alloy and the like.

On the other hand, from the viewpoint of moldability, the use of milled carbon fibers is advantageous in respect of the degree of freedom of molding and molding/working costs, although the molding with the use of lengthy carbon fibers is suitable for producing a fiber-reinforced metal composite having excellent mechanical properties.

The use of the milled carbon fibers in the fiber-reinforced metal composite leads to the increase of the surface area brought into contact with metals. The opportunity of reaction with the metals becomes high as much as the above increase, so that greater attention must be paid to the formation of carbides.

Coating with silicon carbide or precoating with a matrix metal, such as aluminum, at low temperatures has been tried for the purpose of improving the wettability with metals and suppressing the above reaction.

However, these conventional trials have had a drawback in that the efficacy is low for the cost increase involved.

The inventors have made extensive and intensive studies with a view toward resolving the above problems. As a result, they have found that the configuration of the milled carbon fiber, especially the morphology of the surface thereof, has an important relationship with the formation of carbides with metals, and that the reaction of the milled carbon fiber with metals can be suppressed by improving the above configuration. The present invention has been completed on the basis of the above findings.

OBJECT OF THE INVENTION

The present invention has been made with a view toward obviating the above drawbacks of the prior art. Thus, the object of the present invention is to provide milled carbon fibers which have desirably grown graphite layer planes and accordingly a low reactivity with metals, so that it can provide a lightweight and rigid fiber-reinforced metal having excellent heat resistance at high temperatures, and also to provide a process for producing the desired milled carbon fibers.

SUMMARY OF THE INVENTION

The milled carbon fibers of the present invention are one produced from mesophase pitch, which have a fiber cut surface and a fiber axis intersecting with each other at cross angles, the smaller one thereof being at least 65° on the average.

The milled carbon fibers of the present invention preferably have a specific surface area as measured by the BET method of 0.2 to 10 $m^2/g$.

The process for producing milled carbon fibers according to the present invention comprises the steps of:

melt spinning mesophase pitch to obtain pitch fibers;

infusibilizing the obtained pitch fibers;

milling the infusible pitch fibers as obtained or after a primary heat treatment at 250 to 1500° C. in an nert gas; and subjecting the obtained milled fibers to a high-temperature heat treatment at 1500° C. or higher in an inert gas.

BRIEF DESCRIPTION OF THE DRAWING

FIGURE is a schematic perspective of the milled carbon fiber provided for explaining the cross angle of a fiber cut surface and a fiber axis intersecting with each other.

DETAILED DESCRIPTION OF THE INVENTION

The present invention will now be illustrated.

The pitch as the starting material of the milled carbon fiber according to the present invention is optically anisotropic pitch, i.e., mesophase pitch. The mesophase pitch can generally be produced from petroleum, coke and other various raw materials. The mesophase pitch as the starting material for use in the present invention is not particularly limited as long as it is spinnable.

The desired mesophase-base carbon fiber produced by subjecting the above starting pitch to spinning, infusibilization and carbonization or graphitization according to the customary procedure permits free control of the crystallization degree thereof.

The terminology "milled carbon fiber" used herein means a carbon fiber which is shorter than the carbon fiber of about 1 to 25 mm generally known as "chopped strand" and which has a length of about 1 mm or less.

The milled carbon fibers of the present invention have a fiber cut surface and a fiber axis intersecting with each other at cross angles, the smaller one thereof being at least 65°, preferably at least 70°, still preferably at least 75° on the average. The cross angle of the fiber cut surface and the fiber axis intersecting with each other will be illustrated below with reference to the appended FIGURE. The appended FIGURE is a schematic perspective of an end portion of the milled carbon fiber provided for explaining the cross angle of the fiber cut surface and the fiber axis of the carbon fiber intersecting with each other. As illustrated, the carbon fiber 1 has a fiber cut surface (s) formed by the milling at an end portion thereof. In the present invention, the smaller angle (θ), on the average, of the cross angles of the fiber cut surface (s) and the fiber axis (d) of the carbon fiber 1 intersecting with each other is used as the above value for numerical limitation.

Herein, the average of the cross angle (θ) is an average of the cross angles of at least 100 milled carbon fibers. In the calculation of the average of the cross angle (θ), when the carbon fiber has suffered from longitudinal crack along the fiber axis (d) on the fiber cut surface during milling, the cross angle (θ) is defined to be 0°. The average of the cross angle (θ) of the fiber cut surface (s) and the fiber axis (d) intersecting with each other can be measured by the use of a scanning electron microscope (SEM).

The milled carbon fibers having an average of the cross angle (θ) of the fiber cut surface (s) and the fiber axis (α) intersecting with each other which is at least 65° are cylindrical in the entire configuration thereof and have no sharply projecting portions such as an acicular portion from the fiber cut surface. That is, the milled carbon fiber of the present invention is cylindrical in the entire configuration thereof, and has a fiber cut surface nearly perpendicular to the fiber axis, in which the graphite layer has few sharp unevennesses inside.

The distribution of graphitization degree in the direction of the inner diameter of the cut surface of the carbon fiber produced from a starting pitch material is reported in G. Katagiri, H. Ishida and A. Ishitani, carbon 26, 565 (1988). This reference shows that the nearer the surface the portion concerned, the greater the graphitization degree and the higher the crystallization degree there. Also, as mentioned above, it is preferred that the reinforcing carbon fiber for use in the CFRM be graphitized for reducing the formation of carbides due to the reaction with molten alloys. Therefore, in the carbon fiber derived from mesophase pitch, it is important that the carbon with low crystallization degree having originally been present inside the fiber is less exposed to the surface of the fiber during the milling.

On the other hand, the inventors' study and observation have revealed that the angle of the cutting of the carbon fiber becomes nearly parallel to the fiber axis, depending on the force applied to the carbon fiber during milling, so that the carbon fiber is cleaved along the graphite layer plane to thereby expose much of sharply uneven graphite layer plane present inside the fiber and, in extreme cases, to render the fiber acicular. The above average of the cross angle (θ) of this milled carbon fibers is less than 65°.

The above milled carbon fibers which are extremely marked in the area of exposure of the graphite layer plane having originally been present inside the carbon fiber, the above exposure resulting from the frequent cleavages along the fiber axis and along the graphite layer plane during milling, that is, the milled carbon fibers whose average of the cross angle (θ) is less than 65°, are disadvantageous in molding and long-time use at high temperatures. This is because, when the temperature is high during the molding and use, the formation of carbide due to the contact with the metal is extremely increased, thereby gravely deteriorating the strength of the carbon-fiber-reinforced metal.

This strength deterioration would be attributed to an extreme increase in the area of exposure of the reactive graphite layer plane having originally been present inside the fiber, the above exposure resulting from cleavage along the fiber axis during the milling, which increase would cause the reaction between the metal and the carbon to proceed on the graphite layer plane.

For being suitable for use as metal fiber reinforcement, it is preferred that the milled carbon fibers of the present invention have a relatively small specific surface area. Specifically, it is preferred that the specific surface area as measured by the BET method be in the range of 0.2 to 10 $m^2/g$, especially 0.3 to 7 $m^2/g$. The specific surface area of the milled carbon fibers is measured in accordance with the BET one-point method in sorption and desorption of nitrogen gas at a relative pressure of 0.3.

When the above specific surface area is less than 0.2 $m^2/g$, the wettability of the milled carbon fibers with a metal is likely to decrease so as for bubbles to remain between the fibers and the metal during the molding, thereby deteriorating the strength properties of the carbon-fiber-reinforced metal.

On the other hand, when the above specific surface area exceeds 10 $m^2/g$, the surface area brought into contact with the metal is likely to be extremely high so as to increase the opportunity of carbide formation, thereby lowering the strength of the carbon-fiber-reinforced metal.

The milled carbon fibers of the present invention have been described, and, hereinafter, the process for producing the milled carbon fibers will be described.

The process for producing the milled carbon fibers of the present invention is not particularly limited as long as the value of the cross angle of the fiber cut surface and the fiber axis intersecting with each other is as described above and as, preferably, the value of the specific surface area as measured by the BET method is also as described above.

The above process, for example, comprises spinning the above mesophase pitch to obtain pitch fibers, infusibilizing the pitch fibers, milling the obtained infusible pitch fibers and effecting carbonization/graphitization of the milled fibers.

The pitch fiber may be spun by any of the conventional melt, centrifugal, vortex and other spinning techniques. Especially, the melt blow spinning technique is preferred, collectively taking into account the production costs including spinning apparatus construction and operating costs and the quality control including the degree of freedom in controlling fiber diameters.

The thus obtained pitch fiber is infusibilized by the conventional method. Although this infusibilization can be effected by heating in an oxidative atmosphere of air, oxygen, nitrogen dioxide or the like or treating in an oxidative solution of nitric acid, chromic acid or the like, practically, it is preferred that the infusibilization be performed by heating in air at temperatures ranging from 150 to 350° C. in which the heating temperature is elevated at a heat-up rate of 3 to 10° C./min.

The infusibilized pitch fiber may directly be milled and subjected to high-temperature heat treatment for carbonization/graphitization. Alternatively, it may first be subjected to primary heat treatment at lower temperatures, and then milled and subjected to the high-temperature heat treatment.

The milling of the infusibilized pitch fiber or the primarily heat-treated carbon fiber may be performed by a procedure comprising revolving a rotor equipped with a blade at a high speed and contacting the fiber with the blade to thereby cut the fiber in the direction perpendicular to the fiber axis. In this procedure, the milling may be performed by the use of, for example, the Victory mill, jet mill or cross flow mill. In the above procedure, the length of the milled pitch (or carbon) fiber can be controlled by regulating the rotating speed of the rotor, the angle of the blade, the size of porosity of a filter attached to the periphery of the rotor, etc.

In the prior art, the milling of the carbon fiber has also been performed by means of the Henschel mixer, ball mill or mixing machine. This milling cannot be stated to be an appropriate procedure because not only does pressure apply to the carbon fiber in the direction of the diameter thereof to thereby increase the probability of longitudinal cracks along the fiber axis but also the milling takes a prolonged period of time.

The above primary heat treatment prior to the milling may be performed in an inert gas at 250 to 1500° C., preferably 400 to 1200° C., still preferably 600 to 1000° C.

In the carbon fiber derived from mesophase pitch, the crystallization degree of the carbon is increased with the increase of the heat treating temperature, thereby growing the graphite layer, whose plane is oriented parallel to the fiber axis. Thus, when heat treatment is conducted in an inert gas at temperatures exceeding 1500° C. before milling, the carbon fiber is likely to suffer from cleavage and breakage along the graphite layer plane having grown along the fiber axis. The resultant milled carbon fiber is not desirable because the proportion of reactive broken surface area to the total surface area of the milled carbon fiber is high to thereby promote the reaction between the reactive carbon and the metal.

The milled mesophase-pitch-based infusibilized pitch fiber obtained by milling directly after the infusibilization or the milled primarily heat-treated carbon fiber obtained by milling after the primary heat treatment, is subjected to a high-temperature heat treatment at 1500° C. or higher, preferably 1700° C. or higher, still preferably 2000° C. or higher.

High-temperature heat treatment at temperatures lower than 1500° C. is not suitable because the degree of graphitization of the milled carbon fiber is so low that the reaction with metals is likely to occur.

The high-temperature heat treatment after milling causes highly reactive carbon exposed on the cut surface from the fiber interior during milling to undergo cyclization and thermal polycondensation, so that the fiber cut surface can be converted to the state of low reactivity.

EFFECT OF THE INVENTION

As described above, the milled carbon fibers of the present invention have a fiber cut surface and a fiber axis intersecting with each other at cross angles, the smaller one thereof being at least 65° on the average. Thus, even when the graphite layer plane has achieved high-level growth, the above milled carbon fiber has low reactivity with a metal of high temperature or the like during the molding or use thereof because the proportion of reactive exposed surface of the inner portion of the fiber is small, so that the use of the milled carbon fiber can improve the mechanical strength and high-temperature heat resistance of the carbon fiber/metal composite material.

The process for producing milled carbon fibers according to the present invention comprises melt spinning of mesophase pitch, infusibilization, milling of the infusible pitch fibers as obtained or after a primary heat treatment at 250 to 1500° C. in an inert gas, and a high-temperature heat treatment at 1500° C. or higher in an inert gas. Thus, not only can milled carbon fibers for metal reinforcement having low reactivity with a metal of high temperature or the like during the molding or use thereof so as to be suitable for improvement of the mechanical strength and high-temperature heat resistance of the composite material be provided, but also the degree of graphitization of the carbon fiber can be regulated by selecting appropriate temperature in the high-temperature heat treatment, so that materials suitable for intercalation into graphite layers or for application to fields where the crystallinity of the graphite is utilized can be obtained.

EXAMPLES

The present invention will further be illustrated with reference to the following Examples, which should not be construed as limiting the scope of the invention.

Example 1

A starting material of optically anisotropic petroleum mesophase pitch having a softening point of 280° C. was melted and drawn through a nozzle comprising a 3 mm wide slit and, arranged therein, a line of 1500 spinning orifices each having a diameter of 0.2 mm while injecting hot air through the slit, thereby obtaining pitch fibers. The spinning was conducted at a pitch discharge rate of 1500 g/min, a pitch temperature of 340° C., a hot air temperature of 350° C. and a hot air pressure of 0.2 kg/cm$^2$G.

The spun pitch fibers were collected on a belt having a collection zone of 20-mesh stainless steel net while sucking fiber carrying air from the back of the belt.

The resultant collected fiber mat was heated in air while elevating the temperature from room temperature to 300° C. at an average heat-up rate of 6° C./min to thereby infusibilize the fiber mat.

Part of the thus obtained infusibilized mesophase-pitch-based fibers were milled with the use of a cross flow mill to obtain milled infusibilized fibers, which were successively graphitized at 2650° C. in argon.

An SEM observation of the thus obtained milled carbon fibers derived from mesophase pitch showed that the smaller cross angle of the fiber cut surface and the fiber axis intersecting with each other was 87° on the average, and that the specific surface area of the milled carbon fibers was 1.5 $m^2/g$.

The average length of the milled carbon fibers was 750 $\mu$m.

The thus obtained milled carbon fibers and a powdery aluminum alloy containing 4.5 wt. % of magnesium were uniformly mixed in a weight ratio of 25:75, and charged into a metal mold.

The charged mixture was held at 450° C. for 30 min, and hot-press molded under a pressure of 1000 $kg/cm^2$ for 20 min into a test specimen of 2 mm in thickness, 10 mm in width and 70 mm in length.

This test specimen was subjected to the 3-point bending test according to JIS (Japanese Industrial Standard) R7601, and the bending strength was determined to be 18 $kg/mm^2$.

Another test specimen was prepared in the same manner as above, heated at 600° C. for 5 hr, and subjected to the above bending test. The bending strength was 17 $kg/mm^2$, which indicated that there was substantially no strength deterioration.

Example 2

Another part of the fibers infusibilized in Example 1 were successively subjected to a primary heat treatment at 1250° C. in nitrogen, milling and a high-temperature heat treatment at 2500° C. in argon.

The obtained milled carbon fibers had an average smaller cross angle of 82°, a specific surface area of 6.8 $m^2/g$, and an average fiber length of 700 $\mu$m.

A test specimen of fiber-reinforced aluminum alloy was prepared from the milled carbon fibers derived from mesophase pitch, and the bending test thereof was performed in the same manner as in Example 1.

The bending strengths measured immediately after molding and after successive heating for the predetermined period were 17 $kg/mm^2$ and 15 $kg/mm^2$, respectively.

Comparative Example 1

Still another part of the fibers infusibilized in Example 1 were successively subjected to a high-temperature heat treatment at 2500° C. and milling. An SEM observation showed that many of the milled fibers suffered from longitudinal cracks along the fiber axis, that the average smaller cross angle was 57°, and that the cut surfaces were markedly uneven.

The milled fibers had a specific surface area of 12.3 $m^2/g$ and an average fiber length of 650 $\mu$m. The 3-point bending test was conducted in the same manner as in bending test was conducted in the same manner as in Examples 1 and 2. The bending strength immediately after the test specimen molding was 15 $kg/mm^2$ which could stand comparison with those of the Examples. However, the bending strength after successive heating at 600° C. was 7 $kg/mm^2$, which indicated an extreme deterioration of the bending strength.

What is claimed is:

1. A process for producing milled carbon fibers, which comprises the steps of:

melt spinning mesophase pitch to obtain pitch fibers;

infusibilizing the obtained pitch fibers;

subjecting the obtained infusibilized pitch fibers to a primary heat treatment at 250 to 1500° C. in an inert gas, milling the resultant primarily heat-treated carbon fibers; and subjecting the obtained milled fibers to a high-temperature heat treatment at 1500° C. or higher in an inert gas.

2. The process as claimed in claim 1, wherein the milled carbon fibers have a specific surface area as measured by the BET method of 0.2 to 10 $m^2/g$.

3. The process as claimed in claim 1, wherein the melt spinning is carried out by melt blow spinning.

4. The process as claimed in claim 1, wherein the infusibilizing is carried out by heating in air at temperatures ranging from 150 to 350° C. in which the heating temperature is elevated at a heat-up rate of 3 to 10° C./min.

5. The process as claimed in claim 1, wherein milling is carried out with a Victory mill, jet mill or cross flow mill.

6. The process as claimed in claim 1, wherein the primary heat treatment is carried out at 400 to 1200° C.

7. The process as claimed in claim 6, wherein the primary heat treatment is carried out at 600 to 1000° C.

8. The process as claimed in claim 1, wherein the high-temperature heat treatment is carried out at 1700° C. or higher.

9. The process as claimed in claim 8, wherein the high-temperature heat treatment is carried out at 2000° C. or higher.

* * * * *